US006468379B1

(12) United States Patent
Naito et al.

(10) Patent No.: US 6,468,379 B1
(45) Date of Patent: Oct. 22, 2002

(54) THERMAL TRANSFER RECORDING MEDIUM AND IMAGE FORMING METHOD

(75) Inventors: Akira Naito; Yoshiaki Shiina; Kazumichi Shibuya; Masakazu Amahara, all of Tokyo (JP)

(73) Assignee: Toppan Printing Co., Ltd., Tokyo (JP)

( * ) Notice: Subject to any disclaimer, the term of this patent is extended or adjusted under 35 U.S.C. 154(b) by 120 days.

(21) Appl. No.: 09/670,544

(22) Filed: Sep. 27, 2000

(30) Foreign Application Priority Data

Sep. 30, 1999 (JP) ..... 11-278945
Sep. 22, 2000 (JP) ..... 2000-288992

(51) Int. Cl.[7] ..... B41M 5/34

(52) U.S. Cl. ..... 156/235; 428/195; 428/913; 428/914

(58) Field of Search ..... 156/235; 428/195, 428/913, 914

(56) References Cited

U.S. PATENT DOCUMENTS

| | | | |
|---|---|---|---|
| 4,670,307 A | 6/1987 | Onishi et al. | 427/261 |
| 4,708,903 A | 11/1987 | Tanaka et al. | 428/195 |
| 5,726,698 A | 3/1998 | Shinozaki et al. | 347/172 |
| 5,965,485 A | 10/1999 | Mizumachi et al. | 503/227 |

FOREIGN PATENT DOCUMENTS

| | | |
|---|---|---|
| EP | 0 389 635 | 10/1990 |
| EP | 0 414 225 | 2/1991 |
| EP | 0 698 504 A1 * | 2/1996 |
| EP | 0 882 601 | 12/1998 |
| GB | 2 309 538 | 7/1997 |
| JP | 61-244592 | 10/1986 |
| JP | 63-65029 | 12/1988 |

* cited by examiner

*Primary Examiner*—Bruce H. Hess
(74) *Attorney, Agent, or Firm*—Staas & Halsey LLP

(57) ABSTRACT

A thermal transfer recording medium comprising a substrate, and multi-color thermal transfer recording layers, each of the multi-color thermal transfer recording layers being repeatedly formed for each color along the longitudinal direction of the substrate, wherein each of the multi-color thermal transfer recording layers contains a coloring pigment, an amorphous organic polymer and fine particles. One of the multi-color thermal transfer recording layers is formed to have a larger thickness than the other of the multi-color thermal transfer recording layers. Each of the multi-color thermal transfer recording layers which are successively transferred, excluding the color thermal transfer recording layer to be transferred latest, is formed to have an average thickness of 0.6 $\mu$m or less.

18 Claims, 1 Drawing Sheet

THERMAL TRANSFER RECORDING MEDIUM AND IMAGE FORMING METHOD

CROSS-REFERENCE TO RELATED APPLICATIONS

This application is based upon and claims the benefit of priority from the prior Japanese Patent Applications No. 11-278945, filed Sep. 30, 1999; and No. 2000-288992, filed Sep. 22, 2000, the entire contents of which are incorporated herein by reference.

BACKGROUND OF THE INVENTION

The present invention relates to a thermal transfer recording medium, to an image forming method using the thermal transfer recording medium, and to an image-bearing article formed by the image forming method. In particular, the present invention relates to a method of forming an image based on an area gradation formed of dots, wherein a thermal head printer and a thermal transfer recording medium (thermal ink-transfer ribbon) having a thermal transfer recording layer containing a coloring pigment are employed to thermally transfer the thermal transfer recording layer, in a form of image based on an image data, onto an image-receiving sheet.

More specifically, this invention relates to a thermal transfer recording medium which is suited for use in forming a gradation color image based on area gradation which can be obtained by superimposing dots of multi-color thermal transfer recording layers comprising at least two kinds of color layer, to an image forming method using the thermal transfer recording medium, and to an image-bearing article formed by the image forming method.

With respect to the thermal transfer recording system for forming a gradation image by making use of a thermal head printer, two kinds of transfer systems are known up to date, i.e. a sublimation transferring system and a fusion transferring system.

According to the sublimation transferring system, a thermal transfer recording medium, which is formed of a substrate and a thermal transfer recording layer formed on the substrate and containing a sublimable dye (thermal transfer dye) and a resinous binder, is superimposed on an image-receiving sheet, and then, the sublimable dye in the thermal transfer recording layer is allowed to transfer, in conformity with the quantity of heat from a thermal head, to the image-receiving sheet, thereby forming a gradation image on the image-receiving sheet.

However, when an image is formed by making use of a sublimable dye (thermal transfer dye), the image thus formed is generally poor in durability, so that the application of the sublimation transferring system to the fields where excellency in heat resistance or light-resistance of printed image is demanded would be limited. Further, the thermal transfer recording medium to be employed in the sublimation transferring system is defective in that since the thermal recording sensitivity of the thermal transfer recording medium is poor as compared with the recording medium to be employed in the fusion transferring system, the thermal transfer recording medium is not suited for use as a high-speed recording material to be employed in a recording system employing a high-resolution thermal head which is expected to be actually employed in future for the miniaturization and lightening of a printer to be driven by a battery such as dry battery.

On the other hand, according to the fusion transferring system, a transfer sheet, which is formed of a substrate and a thermally fusible ink transfer layer formed on the substrate and containing a colorant such as dye or pigment and a binder such as wax is superimposed on an image-receiving sheet, and then, energy is applied to a heating device such as a thermal head in conformity with an image data so as to fusion-bond parts of the ink transfer layer to the image-receiving sheet, thereby forming an image. The image formed by way of the fusion transferring system is excellent in density and sharpness and is suited for use in recording a binary image such as letters and linear image. Further, the fusion transferring system enables forming a color image by superimposing a thermal ink-transfer sheet bearing yellow, magenta, cyan and black ink layers on an image-receiving sheet, aside from a low quality of image derived from a low suitability of gradation representation. Such a thermal ink-transfer sheet for forming a color image is disclosed in Japanese Patent Publication S63-65029.

However, in the case of the thermal ink-transfer sheet disclosed in this Japanese Patent Publication S63-65029, since a crystalline wax having a low melting point is employed as a binder for the ink layer, the blurring of ink tends to occur to thereby deteriorating the resolution of image. Additionally, the fixing strength of the image transferred is relatively weak, so that when an image portion is strongly rubbed with one's fingers, the image portion may be vanished.

With a view to solve this problem, various methods have been proposed. For example, a heat sensitive transfer sheet bearing a heat sensitive ink layer comprising not less than 65% of amorphous polymer, a releasable material and a colorant is proposed in Japanese Patent Unexamined Publication S61-244592.

However, even in the case of the heat sensitive transfer sheet disclosed in this Japanese Patent Unexamined Publication S61-244592, since a crystalline wax is included in the ink layer, the fixing strength of the portion where a plurality of color images are superimposed is still insufficient.

BRIEF SUMMARY OF THE INVENTION

An object of the present invention is to provide a thermal transfer recording medium which is capable of improving the resolution of images, suitability of gradation representation based on area gradation, the durability of images transferred, the sharp cutting property of the transfer recording layer, and the optical density of transferred image.

Another object of the present invention is to provide an image forming method using the aforementioned thermal transfer recording medium.

A further object of the present invention is to provide an image-bearing article formed by the aforementioned image forming method.

According to a first embodiment of the present invention, there is provided a thermal transfer recording medium comprising; a substrate; and multi-color thermal transfer recording layers, each of the multi-color thermal transfer recording layers being repeatedly formed for each color along the longitudinal direction of the substrate; wherein each of the multi-color thermal transfer recording layers contains a coloring pigment, an amorphous organic polymer and fine particles, and at least one of the multi-color thermal transfer recording layers is formed to have a larger thickness than the other of the multi-color thermal transfer recording layers.

Further, according to a first embodiment of the present invention, there is also provided a method of forming an image by means of a thermal head and by making use of the aforementioned thermal transfer recording medium, the method comprising a step of thermally transferring thermal transfer recording layers of the thermal transfer recording medium to an image-receiving member on a basis of image data to thereby form an image based on an area gradation; the image-receiving member being provided, on the image reception surface thereof, with a layer containing the same kind of amorphous organic polymer as the amorphous organic polymer included in the thermal transfer recording layers.

Still further, according to a first embodiment of the present invention, there is also provided a method of forming an image by means of a thermal head and by making use of a plurality of thermal transfer recording mediums of different colors, each of the thermal transfer recording mediums comprising a substrate and a single-color thermal transfer recording layer formed on the substrate and containing a coloring pigment, an amorphous organic polymer and fine particles, the method comprising a step of successively thermally transferring the single-color thermal transfer recording layers of the thermal transfer recording mediums for each color to an image-receiving member on a basis of image data to thereby form an image based on an area gradation, wherein the single-color thermal transfer recording layer of thermal transfer recording medium is formed to have a larger thickness than the single-color thermal transfer recording layer of the other thermal transfer recording medium.

Still further, according to a first embodiment of the present invention, there is also provided an image-bearing article comprising; an image carrier; and transferred multi-color image of dots formed on the image carrier through a successive thermal transferring using the aforementioned thermal transfer recording medium; wherein the dots of at least one color in the transferred multi-color image is formed to have a larger thickness than that of the dots of the other color in the transferred multi-color image.

According to a second embodiment of the present invention, there is provided a thermal transfer recording medium comprising; a substrate; and multi-color thermal transfer recording layers, each of the multi-color thermal transfer recording layers being repeatedly formed for each color along the longitudinal direction of the substrate; wherein each of the multi-color thermal transfer recording layers contains a coloring pigment, an amorphous organic polymer and fine particles, and each of the multi-color thermal transfer recording layers which are successively transferred, excluding the color thermal transfer recording layer to be transferred latest, is formed to have an average thickness of 0.6 $\mu$m or less.

Further, according to a second embodiment of the present invention, there is provided a method of forming an image by means of a thermal head printer and by making use of the aforementioned transfer recording medium, the method comprising a step of thermally transferring thermal transfer recording layers of the thermal transfer recording medium to an image-receiving member on a basis of image data to thereby form an image based on an area gradation; the image-receiving member being provided, on the image reception surface thereof, with a layer containing the same kind of amorphous organic polymer as the amorphous organic polymer contained in the thermal transfer recording layers.

Still further, according to a second embodiment of the present invention, there is provided a method of forming an image by means of a thermal head and by making use of a plurality of thermal transfer recording mediums of different colors, each of the thermal transfer recording mediums comprising a substrate and a single-color thermal transfer recording layer formed on the substrate and containing a coloring pigment, an amorphous organic polymer and fine particles, the method comprising a step of successively thermally transferring the single-color thermal transfer recording layers of the thermal transfer recording mediums for each color to an image-receiving member on a basis of image data to thereby form an image based on an area gradation, wherein each of the single-color thermal transfer recording layers which are successively transferred, excluding the single-color thermal transfer recording layer to be transferred latest, is formed to have an average thickness of 0.6 $\mu$m or less.

Still further, according to a second embodiment of the present invention, there is provided an image-bearing article comprising; an image carrier; and a transferred multi-color image of dots formed on the image carrier through a successive thermal transferring using the thermal transfer recording medium claimed in claim 11; wherein the dots of the transferred color image excluding the dots of transferred color image positioned highest in the superimposed dots of multi-color which are successively transferred, are formed to have an average thickness of 0.6 $\mu$m or less.

Still further, according to a second embodiment of the present invention, there is provided an image-bearing article comprising; an image carrier; and a transferred multi-color image of dots formed on the image carrier from an intermediate image carrier having dots of an intermediate multi-color image transferred through a successive thermal transferring using the aforementioned thermal transfer recording medium; wherein the dots of the transferred color image excluding the dots of transferred color image positioned lowest in the superimposed dots of multi-color which are successively transferred, are formed to have an average thickness of 0.6 $\mu$m or less.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1A:
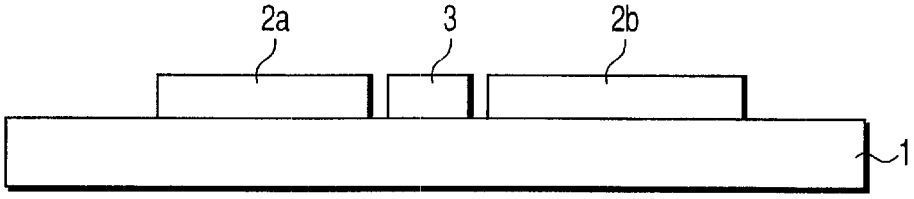
FIG. 1A is a cross-sectional view illustrating problems involved in a conventional thermal transfer recording medium.

The thermal transfer recording medium according to this invention is featured in that it comprises a substrate, and multi-color thermal transfer recording layers, each of said multi-color thermal transfer recording layers being repeatedly formed at least along the longitudinal direction of said substrate, which is featured in that each of said multi-color thermal transfer recording layers contains a coloring pigment, an amorphous organic polymer and fine particles, and that the thickness of the multi-color thermal transfer recording layers is suitably controlled.

The principle of transferring of the thermal transfer recording medium is as follows. Namely, at first, the thermal transfer recording layer is heated by a heating medium such as a thermal head. As a result, the amorphous organic polymer which is contained in the thermal transfer recording layer is turned into a molten state, semi-molten state, or softened state, thereby separating the thermal transfer recording layer from the substrate, rendering the thermal transfer recording layer to become tacky, and hence allowing the thermal transfer recording layer to thermally adhere onto the image-receiving sheet, thus recording an image. Therefore, when a printing is performed by superimposing dots of at least two kinds of color, it is possible to obtain a clear image free from a blur of ink. Additionally, the recorded image thus transferred is excellent in mechanical strength.

By the way, it is assumed that the phenomenon of the transferring of thermal transfer recording layer as the amorphous organic polymer contained therein is thermally semi-molten or softened as mentioned above can be attributed not only to the kind of material of the thermal recording transfer layer but also to the fact that the thermal transfer recording layer is extremely thinned, so that this transferring type may be defined as being more close to a thermal peeling system of adhered thin film (Japanese Patent Unexamined Publication H7-117359) rather than the conventional fusion transferring system. Because the transferring type according to the traditional fusion transfer system is assumed to be such that the transferring is brought about as the thermal transfer recording layer is simply molten.

The thermal transfer recording layer can be constructed to have at least three thermal transfer recording layers bearing cyan, magenta and yellow color, respectively, each color thermal transfer recording layer being separately and alternately formed along the longitudinal direction of the substrate. When each of the thermal transfer recording layers thus constructed is successively transferred, a multi-color image can be obtained with an excellent working efficiency.

The thermal transfer recording medium, the image forming method using the thermal transfer recording medium, and the image-bearing article formed by the image forming method, all according to this invention, can be generally classified into the following two embodiments.

The thermal transfer recording medium according to the first embodiment of this invention is featured in that among the multi-color thermal transfer recording layers, each of said multi-color thermal transfer recording layers being repeatedly formed along the longitudinal direction of said substrate, one color thermal transfer recording layer is formed to have a larger thickness than that of the rest of the multi-color thermal transfer recording layers.

When one specific color thermal transfer recording layer selected from these three-color thermal transfer recording layers is formed thicker than others, a multi-color image having a high density and exhibiting a well-balanced hue can be obtained.

Namely, generally speaking, since the configuration of dot and the tone reproducibility are largely affected by the thickness of thermal transfer recording layer and are caused to differ, the thickness of each color thermal transfer recording layer is generally made identical with each other. However, there is a possibility that since the optical density frequently differs depending on the kind of color component, it is difficult to obtain a sufficient density of a specific color such for example as yellow.

Therefore, according to the first embodiment of this invention, one specific color thermal transfer recording layer, which is difficult to obtain a sufficient color density, is formed thicker than other color thermal transfer recording layers, because as far as the thickness of thermal transfer recording layer is confined within a predetermined range, the configuration of dot as well as the tone reproducibility would not be badly affected even if the thickness of each of the multi-color thermal transfer recording layers is separately differentiated from others. That is, the thickness of the thermal transfer recording layer is altered depending on color. By doing so, it becomes possible to obtain a sufficient optical density in every colors, thus making it possible to form a color image having a high density and exhibiting a well-balanced hue without deteriorating the configuration of dot as well as the tone reproducibility.

According to this first embodiment of this invention, there are also provided a method of forming an image by means of a thermal head printer and by making use of the aforementioned thermal transfer recording medium, wherein the printing of an image based on an area gradation is performed on a basis of image data. Further, according to this first embodiment of this invention, there are also provided an image-bearing article obtained by the aforementioned image forming method.

The thickness of the thermal transfer recording layer of the thermal transfer recording medium can be hardly changed by the thermal transferring. This trend becomes prominent when the thermal transfer recording layer contains resins in an amount larger than low melting-point material (e.g., wax). For that reason, the dot thickness of one of the multi-color thermal transfer recording layers can be printed thicker than the dot thickness of other color thermal transfer recording layers even in the image-bearing article obtained through the employment of the aforementioned thermal transfer recording medium.

The method of forming an image is applicable not only to the above-described thermal transfer recording medium where a plurality of colors are to be separately formed on the substrate, but also to the thermal transfer recording medium where only a single color thermal transfer recording layer is to be formed on the substrate. In this method, a plurality of thermal transfer recording mediums are used by the same number as that of a plurality of colors.

In this case, the plural colors include at least cyan, magenta and yellow, and yellow color thermal transfer recording layer is formed to have a larger thickness than the thickness of the cyan color thermal transfer recording layer and than the magenta color thermal transfer recording layer.

The second embodiment of this invention is featured in that all of the multi-color thermal transfer recording layers which are successively transferred, excluding the color thermal transfer recording layer to be transferred latest, are formed to have an average thickness of 0.6 $\mu$m or less.

On the occasion of forming an image consisting of dots based on area gradation by selectively heating a plurality of (e.g., yellow, magenta, cyan, etc.) thermal transfer recording layers (ordinarily, from the substrate side) by means of a thermal head, the thermal transfer recording layer of a first coloring is heated to form the dots thereof at first, and then, the thermal transfer recording layer of a second coloring is heated to form the dots thereof over the dots of the first coloring. In this manner, the transferring of a third coloring and a fourth coloring is repeated. The number of repetition corresponds to the number of colors. It has been discovered by the present inventors however that on the occasion of forming the dots of second coloring as well as of the colorings succeeding thereto, the total physical height (thickness) of dots that has been formed in advance gives a very great influence to the configuration of the dots to be subsequently formed thereon.

This trend can be characteristically recognized in a thermal transfer recording medium which contains an amorphous organic polymer as a main component as in the case of this invention as compared with the conventional thermal transfer recording medium which contains a crystalline wax as a main component. The reason for this can be attributed to the fact that in the case of the former recording medium, the thickness of thermal transfer recording layer formed can be collapsed by the effect of heating (therefore, the image is blurred), whereas in the case of the latter recording medium (comprising an amorphous organic polymer as a main component), the thickness of thermal transfer recording layer formed reproducibly appears in the thickness of the dots and is reflected on the excellent configuration of dots (therefore, the image is not blurred).

Based on this finding, this invention now provides a method wherein the thickness of each of thermal transfer recording layers to be formed as a recording medium is controlled so as to differ from each other, thereby preventing the generation of blur of image, and also enabling the dots of the second coloring as well as of the colorings succeeding thereto to become clear in configuration.

The manner of transferring dots on the surface of substrate 1 may be such that after a dot 2*a* of the first coloring is formed on the surface of substrate 1, another dot 2*b* of the first coloring is formed in the vicinity of the dot 2*a*, and then, a dot 3 of the second coloring is interposed between the dot 2*a* and the dot 2*b* as shown in FIG. 1A. Alternatively, a large dot 3*a* of the second coloring is formed over the dot 2*a* of the first coloring, or a dot 3*b* of the second coloring is formed partially overlapping with the dot 2*b* of the first coloring as shown in FIG. 1B.

Figure 1B:
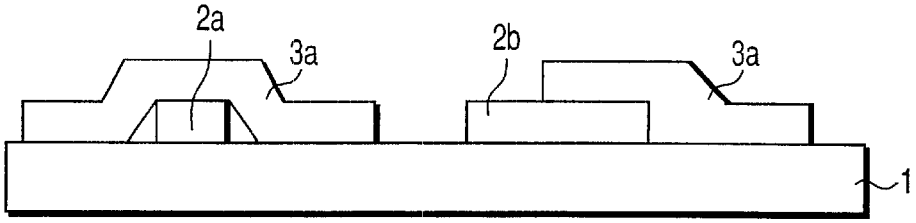
FIG. 1B is a cross-sectional view illustrating problems involved in a conventional thermal transfer recording medium.

In the case of transferring as shown in FIG. 1B, if the height of the dots 2*a* and 2*b* of the first coloring was too high (the thickness of the dots 2*a* and 2*b* of the first coloring was too large), it was expected that the presence of these dots 2*a* and 2*b* would obstruct the formation of the dots 3*a* and 3*b* of the second coloring. When this possibility was examined through the experiments by the present inventors, it was found that depending on whether the thickness of the thermal transfer recording layer of the first coloring was less than or more than 0.6 μm, the configuration of dot after the second coloring as well as of the colorings succeeding thereto was caused to change extremely.

Namely, if the thickness of the thermal transfer recording layer of the first coloring exceeded over 0.6 μm, the configuration of dot became unstable and discoloration was caused in the thermal transferring of thermal transfer recording layer of the second coloring or of the colorings succeeding thereto. However, when the thickness of the thermal transfer recording layer of the first coloring was confined to not more than 0.6 μm, the configuration of dot was stabilized, thus making it possible to obtain an image which was free from discoloration and excellent in tone reproduction.

Further, in order to obtain a clear image, it is preferable to consider not only the uniformity in configuration of dots, but also the density of color. It has been found that, when the optical reflection density is preferably at least 1.1 or more on a white substrate, it becomes easy to enable the uniformity in configuration of dots to be directly lead to the clearness of image.

Further, it has been also found that when an average particle diameter of coloring pigment is not more than 0.5 μm and at the same time, when the ratio of pigment having a particle diameter of more than 1 μm is not more than 10%, the effect to be derived from the controlling of average thickness of the aforementioned thermal transfer recording layer can be optimized. Namely, the existence of macroaggregate in the coloring pigment would undesirably disturb the profile of dot.

The average particle diameter of pigment can be measured by making use of AUTOSIZER available from MARVERUN Co., Ltd., based on light-scattering system, Coulter counter method, the processing of SEM observation image, etc.

Although there is not any particular rules on the order of printing the colors, the color ink layer or layers which the thickness thereof is required to be limited to 0.6 μm or less are all of the color ink layers except the ink layer to be printed latest or in the end. Namely, if yellow, magenta and cyan ink layers are printed in the mentioned order, even though the thickness of each of yellow and magenta ink layers (thermal transfer recording layers) is required to be limited to 0.6 μm or less, there is substantially no limitation with respect to the thickness of the cyan ink layer.

According to the second embodiment of this invention, there is provided a method of forming an image based on an area gradation on the basis of image data by making use of the aforementioned thermal transfer recording medium and by means of a thermal head printer. According to the second embodiment of this invention, there is also provided an image-bearing article to be obtained by the aforementioned image forming method. Since the thickness of thermal transfer recording layer of the thermal transfer recording medium cannot be substantially altered even after the thermal transferring process thereof, all of the dots of colors formed on the image-bearing article by making use of the aforementioned recording medium, excluding color of the dot formed highest, would have an average thickness of 0.6 μm or less.

The method of forming an image is applicable not only to the above-described thermal transfer recording medium where a plurality of colors are to be separately formed on the substrate, but also to the thermal transfer recording medium where only a single color is to be formed on the substrate. In this method, a plurality of thermal transfer recording mediums are used by the same number as that of a plurality of colors.

In this case, the plural colors include at least cyan, magenta and yellow.

By the way, as described hereinafter, when it is difficult to thermally transfer a transferring image by means of a thermal head printer directly to an image carrier on which the image is desired to be ultimately formed, the image is thermally transferred to an intermediate image-receiving sheet (intermediate image-bearing article), and then, the image thus transferred to the intermediate image-receiving sheet is re-transferred to the ultimate image-bearing article. In this case, the order of laminated dots of the transferred color image formed on the ultimate image-bearing article becomes opposite to the case where the image is directly formed on the image-bearing article by thermal transferring using a thermal head printer. Therefore, all of the dots of the transferred color image formed on the ultimate image-bearing article, excluding the dot of the transferred color image formed closest to the ultimate image-bearing article, would have an average thickness of 0.6 μm or less.

By the way, as for the system for transferring an image on an image carrier constituting the ultimate image-supporting body after the image has been once transferred to an intermediate image-receiving sheet (an intermediate image carrier), it can be generally classified into two methods.

Namely, (1) a system of transferring an image (formed of a large number of dots) formed on the intermediate image-receiving sheet to the surface of an image carrier together with an image receiving layer having an image-recording face where the aforementioned image has been formed. In this case, the intermediate image-receiving sheet should be constructed in advance in such a manner that the aforementioned image-receiving layer can be easily peeled away from the substrate thereof. According to this system, since the image-receiving layer is enabled to function also as a protective layer for the image after it has been transferred to the image carrier, it is advantageous in this respect.

The other is (2) a system wherein only the image (formed of a large number of dots) formed on the intermediate image-receiving sheet is transferred to the surface of an image carrier. Namely, by contrast to the former system, the image-receiving layer having an image-recording face where the aforementioned image has been formed is not transferred together with the image. According to this system, if it is desired to cover and protect the image formed on the image carrier with a protective layer, the protective layer is required to be additionally applied thereto through an additional step such as transferring, coating, etc.

In any of the aforementioned systems (1) and (2), a transferring method using heat and pressure can be conveniently employed in general on the occasion of transferring the image. However, any other method employing other than heat and pressure can be also employed as a transferring method of the image. Further, it may be also preferable, on the occasion of transferring the image onto the image carrier, to interpose an adhesive or an adhesive sheet between the surface of the image carrier to which the image is to be transferred and the image-carrying surface of the intermediate image-receiving sheet. In any of the aforementioned systems (1) and (2), a plurality of colors constituting an image and formed on the intermediate image-receiving sheet may be transferred en bloc to the image carrier, or otherwise, each of the colors for forming an image may be separately transferred to the image carrier every time each of the colors has been formed on the intermediate image-receiving sheet. The selection of which system should be adopted will be optionally determined depending on the process or the intermediate image-receiving sheet to be employed.

Next, the thermal transfer recording medium according to this invention will be explained in detail.

Figure 2:
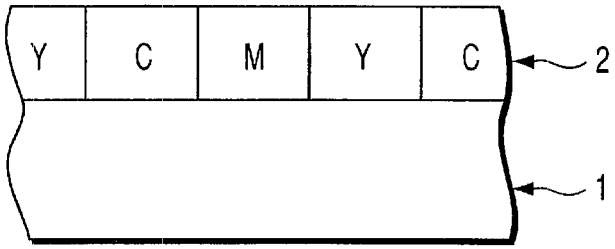
FIG. 2 is a cross-sectional view illustrating a thermal transfer recording medium according to one embodiment of the present invention.

FIG. 2 shows a thermal transfer recording medium according to this invention, wherein a thermal transfer recording layer 2 is formed on a substrate 1. As for the materials useful for the substrate 1 in this invention, those that are generally employed in the sublimation transferring system or in the fusion transferring system can be employed. Specific examples of the materials useful for the substrate 1 include plastic films made of polyethylene terephthalate, polyethylene naphthalate, polypropylene, cellophane, polycarbonate, polyvinyl chloride, polystyrene, polyimide, nylon or polyvinylidene chloride; and paper such as condenser paper, paraffin paper, etc., most preferable example being polyester film.

The thickness of the substrate 1 should preferably be in the range of 2 to 50 μm, more preferably in the range of 2 to 16 μm.

The thermal transfer recording layer 2 contains a coloring pigment, an amorphous organic polymer and fine particles.

As for the amorphous organic polymer to be incorporated into the thermal transfer recording layer 2, butyral resin, polyamide resin, polyester resin, epoxy resin, acrylic resin, vinly chloride, a copolymer of vinyl monomers such as vinyl chloride, vinly acetate, etc., or a copolymer of a vinyl monomer with other kinds of monomer.

Depending on the property to be demanded of a printed matter to be ultimately obtained, various kinds of wax or a low molecular fluid may be optionally employed. In particular, where the heat resistance or scuff resistance of printed matter is demanded, it is preferable to employ only an amorphous organic polymer. Even so, it is still possible to obtain a clear image according to this invention.

When epoxy resin is employed as an amorphous organic polymer, it is preferable, in view of printing suitability thereof to a heating medium such as a thermal head and the fastness of image after the transfer recording, to select from those having a softening point ranging from 70° C. to 150° C.

The heating condition for the thermal transferring using a thermal head is generally a period of several milliseconds at a temperature ranging from 180 to 400° C. Further, when it is desired to perform the thermal transfer recording as mentioned above, the heating should be performed until epoxy resin is fused, semi-molten, or softened.

Therefore, when the quantity of heat to be supplied from a thermal head as well as the fused state of epoxy resin are taken into consideration, the upper limit of melting point of epoxy resin would become 150° C. If an epoxy resin having a melting point exceeding this upper limit is employed, a larger quantity of energy than that to be used on the occasion of transferring would be required, thereby greatly shortening the life of thermal head.

The reason for setting the lower limit of the melting point of epoxy resin to 70° C. is to secure the preservation stability of image after the transfer recording. Namely, when an epoxy resin having a melting point of less than 70° C. is employed, a phenomenon of tailing would be generated as the image printed is rubbed with one's fingers.

With respect to the features of epoxy resin to be employed as a main material for the thermal transfer recording layer of this invention, the epoxy equivalent (number of grams of a resin containing 1 g of epoxy group) should preferably be in the range of 600 to 5000, and the weight-average molecular weight thereof should preferably be in the range of 800 to 5000.

If this epoxy equivalent of epoxy resin is lower than the aforementioned lower limit (less than 600), the fastness of image against the rubbing would become insufficient, so that when the image portion is rubbed with one's fingers, a tailing of image would be easily generated. On the other hand, if this epoxy equivalent is more than the aforementioned upper limit (exceeding over 5,000), the heat energy to be used on the occasion of transferring would become too excessive, thereby greatly shortening the life of thermal head, and, additionally, since the sensitivity of the recording layer to the thermal transferring would become low, the recording layer cannot be suitably employed for a high speed thermal transfer recording of image.

Further, if the weight-average molecular weight of epoxy resin is lower than the aforementioned lower limit (less than 800), the fastness of image against the rubbing would become insufficient, so that when the image portion is rubbed with one's fingers, a tailing of image would be easily generated. On the other hand, if the weight-average molecular weight is more than the aforementioned upper limit (exceeding over 5,000), the heat energy to be used on the occasion of transferring would become too excessive, thereby greatly shortening the life of thermal head, and, additionally, since the sensitivity of the recording layer to the thermal transferring would become low, the recording layer cannot be suitably employed for a high speed thermal transfer recording of image.

Therefore, most preferable kind of epoxy resin in this invention would be one which simultaneously meets all of the conditions defined by the aforementioned ranges regarding the softening point, epoxy equivalent and weight-average molecular weight. When the epoxy resin simultaneously meets all of these conditions, it would become especially effective in enhancing the transferring property and fastness of image.

Because of the above reasons, epoxy resin should be selected from those having a melting point ranging from 70 to 150° C., an epoxy equivalent ranging from 600 to 5000, and a weight-average molecular weight ranging from 800 to 5000.

Specific examples of such an epoxy resin are diglycidyl ether type epoxy resin such as bisphenol A diglycidyl ether, bisphenol F diglycidyl ether, resorcinol diglycidyl ether, cresol novolak polyglycidyl ether, tetrabrome bisphenol A diglycidyl ether and bisphenol hexafluoroacetone glycidyl ether; glycidyl ester type epoxy resin such as diglycidyl phthalate and diglycidyl dimerate; glycidyl amine type epoxy resin such as triglycidyl isocyanurate, tetraglycidyl aminodiphenyl methane and tetraglycidyl methaxymene diamine; and aliphatic epoxy resin such as hexahydrobisphenol A diglycidyl ether, polypropylene glycol diglycidyl ether and neopentylglycol diglycidyl ether. Any one of these epoxy resins can be suitably selected.

Fine particles contained in the thermal transfer recording layer 2 function as a filler. Further, the fine particles should preferably be colorless or light-colored. By the expressions of "colorless" or "light-colored", it means that the color of the fine particles is so thinned that the color or density of the transferred image formed from the thermal transfer recording layer would not be substantially influenced by the color of fine particles.

The fine particles are essential for improving the transferability of the thermal transfer recording layer on the occasion of thermal transferring, in particular, the configuration of dots forming a transferred image or the tone reproduction. The reason for employing colorless or light-colored fine particles is not to obstruct the coloring of colored image to be formed by the thermal transferring. Examples of the colorless or light-colored fine particles include silica, calcium carbonate, kaolin, clay, starch, zinc oxide, Teflon powder, polyethylene powder, polymethylmethacrylate beads, polyurethane beads, benzoguanamine and melamine resin beads. Among them, silica fine particle is most preferable for use.

As for the coloring pigment to be incorporated into the thermal transfer recording layer 2, it is possible to employ various kinds of pigments. For example, for the purpose of monochromatic black printing, the employment of carbon black is more preferable, whereas for the purpose of multicolor printing, three kinds of pigments for forming yellow, magenta and cyan colors, or four kinds of pigments which include a black color pigment in addition to the aforementioned three kinds of pigments can be employed. These pigments can be employed singly or in combination of two or more kinds.

In the case of the multicolor printing, the employment of organic pigments may be preferable if faithful reproduction of chromaticity is demanded of, in addition to the configuration of dots. In particular, if a full color is to be faithfully reproduced by way of dot-on-dot of yellow, magenta and cyan colors, the sharpness in hue of pigment is an important factor, so that at least 80% of coloring pigments should preferably be occupied by organic pigments.

Examples of such organic pigments useful in this case include azo pigments such as phthalimide type yellow, benzimidazolone orange, sulfoamide yellow, benzimidazolone yellow, etc.; phthalocyanine pigments; and condensed polycyclic pigments such as diketopyrrolopyrrole, quinophthalene, isoindolinone, diaminodianthraquinone, etc.

The content of each component for constituting the composition for forming the thermal transfer recording layer 2 may be confined as follows. Namely, the content of coloring pigments is preferably be 20 to 30 parts by weight, more preferably 25 to 30 parts by weight; the content of the amorphous organic polymer is preferably be 40 to 80 parts by weight, more preferably 50 to 70 parts by weight; and the content of the fine particles is preferably be 1 to 30 parts by weight, more preferably 5 to 15 parts by weight.

If the content of coloring pigments is less than the aforementioned range, it may become difficult to obtain an image of desired density. On the other hand, if the content of coloring pigments is more than the aforementioned range, the mechanical strength of layer may more likely be deteriorated. If the content of the amorphous organic polymer is less than the aforementioned range, the mechanical strength of layer may more likely be deteriorated. On the other hand, if the content of the amorphous organic polymer is more than the aforementioned range, the transferability of the thermal transfer recording layer, in particular, the configuration of dots forming a transferred image or the tone reproduction may more likely be deteriorated. If the content of the fine particles is less than the aforementioned range, the transferability of the thermal transfer recording layer, in particular, the configuration of dots forming a transferred image or the tone reproduction would more likely be deteriorated. On the other hand, if the content of fine particles is more than the aforementioned range, it would become difficult to obtain an excellent fluidity of ink.

In the thermal transfer recording medium of this invention, the thermal transfer recording layer thereof may contain other components in addition to the coloring pigments, the amorphous organic polymer and the fine particles. One example of such other components is a dispersing agent represented by a surfactant. The mixing ratio of the dispersing agent should preferably be in the range of 0.1 to 10 parts by weight based on 100 parts by weight of the total quantity of these coloring pigments, amorphous organic polymer and fine particles.

If the mixing ratio of such other components is too small, the effects to be derived by the addition of such other components would not be exhibited. On the contrary, if the mixing ratio of such other components is excessive, the effects of this invention may not be sufficiently obtained.

When the aforementioned other component is a dispersing agent, the following effects may be obtained by the presence of the dispersing agent. The formation of the thermal transfer recording layer on the surface of substrate is generally performed by a procedure wherein a suitable quantity of a suitable volatile solvent is added to a composition containing suitable quantities of components for forming the thermal transfer recording layer, thereby obtaining a coating solution, a suitable quantity of which is then coated on a predetermined portion of the substrate, the volatile solvent being subsequently allowed to evaporate. In this case, if there is generated an inconvenient phenomenon which may be caused due to an undesirable aggregation of the coloring pigments or fine particles, a dispersing agent mentioned above can be added to the coating solution to thereby provide the coloring pigments or fine particles with a suitable dispersibility, thus overcoming the aforementioned inconvenient phenomenon to be brought about by the aggregation.

The thermal transfer recording medium of this invention can be manufactured by a procedure wherein a composition comprising, for example, coloring pigments, epoxy resin and colorless fine particles, all of which are dispersed or dissolved in a solvent, is coated on the surface of substrate formed of coated paper or (preferably) plastic sheet by means of a solvent coating method such as bar coating, blade coating, air-knife coating, gravure coating or roll coating to obtain a coated layer, which is then dried to form a thermal transfer recording layer, thus manufacturing the thermal transfer recording medium.

By the way, the thickness of the thermal transfer recording layer may be generally a few centimeters, and preferably in the range of 0.2 to 1.0 $\mu$m, more preferably in the range of 0.4 to 0.8 $\mu$m.

Because if the thickness of the thermal transfer recording layer is less than 0.2 $\mu$m, it may become difficult to obtain a sufficient density of colors. On the other hand, if the thickness of the thermal transfer recording layer is larger than 1.0 $\mu$m, because of difference in the resolution level, the transferring thereof in conformity with the heating element portion of thermal head would become difficult, in particular, the configuration of dots forming a transferred image or the tone reproduction would more likely be deteriorated.

By the way, although not shown in the drawings, in addition to the thermal transfer recording layer which is capable of recording at least an image with colors such as YMC (yellow, magenta and cyan) or YMCK (K means black), it is also possible to form a different kind (for a different application) of thermal transfer recording layer on the substrate 1. The provision of this different kind of thermal transfer recording layer on the substrate 1 is applicable not only to the case where a plurality of colors are to be separately formed on the substrate 1, but also to the case where only a single color is to be formed on the substrate 1. Examples of such a thermal transfer recording layer which is not designated to be used for a colored recording, i.e. the aforementioned different kind (for a different object) of thermal transfer recording layer, include an adhesive transfer layer which can be thermally transferred and is capable of functioning as an adhesive layer after it has been transferred, a forgery preventive layer which can be thermally transferred and is capable of functioning as a forgery preventive effect or of facilitating the detection of forgery after it has been transferred, and a special effect-generating layer which can be thermally transferred and is capable of exhibiting a special decorative effect after it has been transferred (a transferable hologram layer, a transferable diffraction grating layer, etc.). These different kinds (for a different object) of thermal transfer recording layers may not necessarily satisfy the requisites demanded for in the case of the coloring pigment-containing thermal transfer recording layer of the thermal transfer recording medium according to this invention.

In the forgery preventive layer exemplified above as one of the aforementioned different kind of thermal transfer recording layer, the existence of fine particulate (or flake-like) material to be incorporated therein are very important. Examples of such a material include a fluorescent substance (or phosphorescent substance) which is capable of generating a fluorescent light (or phosphorescent light) as it is irradiated with an electromagnetic wave of a given wavelength (UV, IR, visible light, etc.), an electromagnetic wave-absorber which is capable of absorbing an electromagnetic wave of a given wavelength (IR, etc.), and $\mu$magnetic material exhibiting magnetism.

Figure 3:
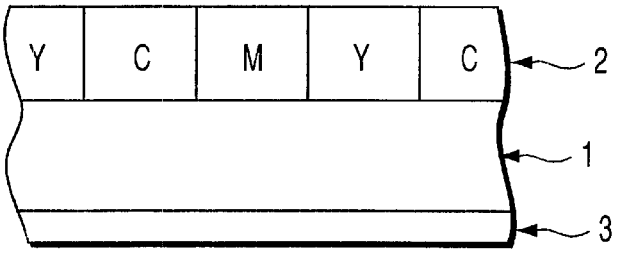
FIG. 3 is a cross-sectional view illustrating a thermal transfer recording medium according to another embodiment of the present invention.

For the purpose of preventing the smooth traveling of the thermal transfer recording medium from being obstructed due to the adhesion of the thermal head to the substrate 1 on the occasion of the transferring of the thermal transfer recording layer 2 to an image-receiving sheet by heating the substrate 1 from the side thereof which is opposite to where the thermal transfer recording layer 2 is formed by means of the thermal head, it is preferable, as shown in FIG. 3, to form a back coat layer 3 on one side of the substrate 1 which is opposite to where the thermal transfer recording layer 2 is formed.

As for the materials useful for constituting the back coat layer 3, it is possible to employ silicone oil-containing nitrocellulose, silicone oil-containing polyester resin, silicone oil-containing acrylic resin, silicone oil-containing vinyl resin, or silicone-modified resin. It is also possible to co-use a crosslinking agent for the purpose of improving the heat resistance of the back coat layer 3.

The thickness of the back coat layer 3 may preferably be about 0.1 to 4 $\mu$m.

As for the materials for the image-receiving sheet to be employed for forming an image by making use of the aforementioned thermal transfer recording medium 1, it is possible to employ paper such as wood free paper, coated paper; plastic film such as polyester film, polyvinyl chloride film, polypropylene film, etc.; or an image-receiving layer-coated paper or plastic film. The image-receiving layer to be employed in this case should preferably be constituted by epoxy resin. Namely, when epoxy resin is employed as an image-receiving layer, even if the thermal transfer recording layer of the thermal transfer recording medium is not sufficiently fused on the occasion of thermal transferring, the thermal transfer recording layer would be enabled to suitably adhere to the image-receiving layer owing to the heat on the occasion of thermal transferring. As a result, the printing can be effected with a sufficient sharp cutting, thereby improving the transferability of the thermal transfer recording layer, in particular, the configuration of dots forming a transferred image or the tone reproduction. Additionally, the image thus formed would become excellent in fastness of image such as abrasion resistance and scuff resistance.

Further, when it is difficult to directly form an image on a sheet on which the image is desired to be ultimately formed, the image may be once formed on the aforementioned image-receiving sheet, after which the transferred image may be re-transferred to the first mentioned sheet or final sheet. According to this indirect transferring method, the selectivity of the final sheet can be expanded, and at the same time, when a protective layer is formed in advance on the image-receiving sheet, this protective layer can be disposed over the finally transferred image, thus improving the fastness of image thus transferred. Alternatively, when a security layer such as a hologram layer is formed in advance on the image-receiving sheet, the security of the finally transferred image can be improved.

As for the means for providing the heat energy to be employed on the occasion of obtaining a tone image expression based on area gradation by making use of the thermal transfer recording medium of this invention and the aforementioned image-receiving sheet, any kinds of conventional means can be utilized. Namely, by controlling the heat energy by making use of these means, a gradation image can be obtained.

The image-bearing article according to this invention can be suitably utilized as various kinds of card, such as an ID card, a cash card, etc., or as a passport.

In the followings, this invention is specifically explained with reference to various examples and various comparative examples, wherein the "parts by weight" and "%" set forth therein are based on weight unless otherwise specified.

The following Examples 1 to 5 are related to the first embodiment of this invention, while Example 6 is related to the second embodiment of this invention.

EXAMPLE 1

An ink composition for thermal transfer recording layer having the following composition was prepared.

(Cyan Ink)

| | |
|---|---|
| Phthalocyanin Blue | 9 parts |
| Epoxy resin (Yuka Shell Epoxy KK; Epicoat 1007) | 20 parts |

Softening point: 128° C.; epoxy equivalent: 1750–2200; weight-average molecular weight: 2900.

Colorless fine particles (silica;

| | |
|---|---|
| Colorless fine particles (silica; Nihon Aerogel Co., Ltd. Aerogel R972) | 4 parts |
| Methylethyl ketone | 67 parts |
| (Magenta ink) | |
| Carmine 6B | 9 parts |
| Epoxy resin (Yuka Shell Epoxy KK; Epicoat 1007) | 20 parts |

Softening point: 128° C.; epoxy equivalent: 1750–2200; weight-average molecular weight: 2900.

| | |
|---|---|
| Colorless fine particles (silica; Nihon Aerogel Co., Ltd. Aerogel R972) | 4 parts |
| Methylethyl ketone | 67 parts |
| (Yellow ink) | |
| Disazo Yellow | 9 parts |
| Epoxy resin (Yuka Shell Epoxy KK; Epicoat 1007) | 20 parts |

Softening point: 128° C.; epoxy equivalent: 1750–2200; weight-average molecular weight: 2900.

| | |
|---|---|
| Colorless fine particles (silica; Nihon Aerogel Co., Ltd. Aerogel R972) | 4 parts |
| Methylethyl ketone | 67 parts |

The inks each having the aforementioned formulation for thermal transfer recording layer were coated successively on the surface of a polyethylene terephthalate film having a thickness of 5.4 μm, the reverse surface thereof being subjected to heat resistance treatment, by making use of a photogravure press to obtain a cyan layer having a thickness of 0.6 μm (dry thickness), a magenta layer having a thickness of 0.6 μm (dry thickness) and a yellow layer having a thickness of 0.8 μm (dry thickness), all of which were separately and repeatedly formed along the longitudinal direction of the film. The coated layers were then dried to obtain a thermal transfer recording medium of this invention.

Then, the following ink for image-receiving layer was coated on the easy adhesion surface of an easy adhesive polyester film having a thickness of 100 μm to form a film having a thickness of 5 μm (dry thickness), which was dried, thereby obtaining an image-receiving sheet.

(Ink for Image-receiving Layer)

| | |
|---|---|
| Epoxy resin (Yuka Shell Epoxy KK; Epicoat 1007) | 30 parts |

Softening point: 128° C.; epoxy equivalent: 1750–2200; weight-average molecular weight: 2900.

| | |
|---|---|
| Methylethyl ketone | 70 parts |

The image-receiving sheet thus obtained was superimposed on the thermal transfer recording surface of the thermal transfer recording medium, and then, by making use of a thermal head, an image based on the area gradation corresponding to the heating element of the thermal head was formed by successively printing the cyan layer, the magenta layer and the yellow layer, thereby forming a full color image based only on the area gradation on the image-receiving sheet.

COMPARATIVE EXAMPLE 1

The following sublimation transfer type ink composition for thermal transfer recording layer was prepared.

(Cyan ink)

| | |
|---|---|
| C.I. Solvent Blue 63 | 5 parts |
| Butyral resin (BX-1, Sekisui Chemical Co. Ltd.) | 5 parts |
| Methylethyl ketone | 60 parts |
| Toluene | 30 parts |
| (Magenta ink) | |
| C.I. Disperse Red 60 | 5 parts |
| Butyral resin (BX-1, Sekisui Chemical Co. Ltd.) | 5 parts |
| Methylethyl ketone | 60 parts |
| Toluene | 30 parts |
| (Yellow ink) | |
| C.I. Disperse Yellow 201 | 5 parts |
| Butyral resin (BX-1, Sekisui Chemical Co. Ltd.) | 5 parts |
| Methylethyl ketone | 60 parts |

-continued

| | |
|---|---|
| Toluene | 30 parts |

The inks each having the aforementioned formulation for thermal transfer recording layer were coated successively on the surface of a polyethylene terephthalate film having a thickness of 5.4 μm, the reverse surface thereof being subjected to heat resistance treatment, by making use of a photogravure press to obtain a cyan layer, a magenta layer and a yellow layer, each layer having a thickness of 1.0 μm (dry thickness), and all layers being separately and repeatedly formed along the longitudinal direction of the film. The coated layers were then dried to obtain a thermal transfer recording medium of the Comparative Example 1.

Then, the following ink for dye-receiving layer was coated on the easy adhesion surface of an easy adhesive polyester film having a thickness of 100 μm to form a film having a thickness of 4 μm (dry thickness), which was dried and then subjected to aging for one week, thereby obtaining an image-receiving sheet.

(Ink for Dye-receiving Layer)

| | |
|---|---|
| Acetal resin | 10 parts |
| Vinyl chloride-vinyl acetate copolymer | 10 parts |
| Silicone oil | 2 parts |
| Isocyanate resin | 3 parts |
| Methylethyl ketone | 50 parts |
| Toluene | 25 parts |

The dye-receiving surface of the image-receiving sheet thus obtained was superimposed on the thermal transfer recording surface of the thermal transfer recording medium, and then, by making use of a thermal head, the yellow layer, the magenta layer and the cyan layer were successively printed to obtain a color image.

COMPARATIVE EXAMPLE 2

A color image was obtained from a thermal transfer recording medium in the same manner as described in Example 1 except that the thickness of all of ink layers for thermal transfer recording layer, i.e. the cyan layer, the magenta layer and the yellow layer was set to 0.6 μm.

COMPARATIVE EXAMPLE 3

A color image was obtained from a thermal transfer recording medium in the same manner as described in Example 1 except that the thickness of all of ink layers for thermal transfer recording layer, i.e. the cyan layer, the magenta layer and the yellow layer was set to 1.2 μmm.

REFERENCE EXAMPLE 1

A color image was obtained from a thermal transfer recording medium in the same manner as described in Example 1 except that the ink composition for thermal transfer recording layer was changed to the following formulation.

(Cyan Ink)

| | |
|---|---|
| Phthalocyanin Blue | 9 parts |

-continued

| | |
|---|---|
| Epoxy resin (Yuka Shell Epoxy KK; Epicoat 1007) | 20 parts |

Softening point: 128° C.; epoxy equivalent: 1750–2200; weight-average molecular weight: 2900.

| | |
|---|---|
| Methylethyl ketone | 71 parts |
| (Magenta ink) | |
| Carmine 6B | 9 parts |
| Epoxy resin (Yuka Shell Epoxy KK; Epicoat 1007) | 20 parts |

Softening point: 128° C.; epoxy equivalent: 1750–2200; weight-average molecular weight: 2900.

| | |
|---|---|
| Methylethyl ketone | 71 parts |
| (Yellow ink) | |
| Disazo Yellow | 9 parts |
| Epoxy resin (Yuka Shell Epoxy KK; Epicoat 1007) | 20 parts |

Softening point: 128° C.; epoxy equivalent: 1750–2200; weight-average molecular weight: 2900.

| | |
|---|---|
| Methylethyl ketone | 71 parts |

REFERENCE EXAMPLE 2

A color image was obtained from a thermal transfer recording medium in the same manner as described in Example 1 except that the ink composition for thermal transfer recording layer was changed to the following formulation.

(Cyan Ink)

| | |
|---|---|
| Phthalocyanin Blue | 9 parts |
| Epoxy resin | 20 parts |
| (Yuka Shell Epoxy KK; Epicoat 1001) | |

Softening point: 64° C.; epoxy equivalent: 450–500; weight-average molecular weight: 900.

| | |
|---|---|
| Colorless fine particles (silica; Nihon Aerogel Co., Ltd. Aerogel R972) | 4 parts |
| Methylethyl ketone | 67 parts |
| (Magenta ink) | |
| Carmine 6B | 9 parts |
| Epoxy resin | 20 parts |
| (Yuka Shell Epoxy KK; Epicoat 1001) | |

Softening point: 64° C.; epoxy equivalent: 450–500; weight-average molecular weight: 900.

| | |
|---|---|
| Colorless fine particles (silica; Nihon Aerogel Co., Ltd. Aerogel R972) | 4 parts |

-continued

| | |
|---|---|
| Methylethyl ketone | 67 parts |
| (Yellow ink) | |
| Disazo Yellow | 9 parts |
| Epoxy resin | 20 parts |
| (Yuka Shell Epoxy KK; Epicoat 1001) | |

Softening point: 64° C.; epoxy equivalent: 450–500; weight-average molecular weight: 900.

| | |
|---|---|
| Colorless fine particles (silica; Nihon Aerogel Co., Ltd. Aerogel R972) | 4 parts |
| Methylethyl ketone | 67 parts |

REFERENCE EXAMPLE 3

A color image was obtained from a thermal transfer recording medium in the same manner as described in Example 1 except that the ink composition for thermal transfer recording layer was changed to the following formulation.

(Cyan Ink)

| | |
|---|---|
| Phthalocyanin Blue | 9 parts |
| Epoxy resin | 20 parts |
| (Yuka Shell Epoxy KK; Epicoat 1010) | |

Softening point: 169° C.; epoxy equivalent: 3000–5000; weight-average molecular weight: 5500.

| | |
|---|---|
| Colorless fine particles (silica; Nihon Aerogel Co., Ltd. Aerogel R972) | 4 parts |
| Methylethyl ketone | 67 parts |
| (Magenta ink) | |
| Carmine 6B | 9 parts |
| Epoxy resin | 20 parts |
| (Yuka Shell Epoxy KK; Epicoat 1010) | |

Softening point: 169° C.; epoxy equivalent: 3000–5000; weight-average molecular weight: 5500.

| | |
|---|---|
| Colorless fine particles (silica; Nihon Aerogel Co., Ltd. Aerogel R972) | 4 parts |
| Methylethyl ketone | 67 parts |
| (Yellow ink) | |
| Disazo Yellow | 9 parts |
| Epoxy resin | 20 parts |
| (Yuka Shell Epoxy KK; Epicoat 1010) | |

Softening point: 169° C.; epoxy equivalent: 3000–5000; weight-average molecular weight: 5500.

| | |
|---|---|
| Colorless fine particles (silica; Nihon Aerogel Co., Ltd. Aerogel R972) | 4 parts |

-continued

| | |
|---|---|
| Methylethyl ketone | 67 parts |

The images obtained in Example 1, Comparative Examples 1, 2 and 3, and Reference Examples 1, 2 and 3 were evaluated on the image tone reproduction, the light resistance and the security. The results are shown in the following Table 1.

TABLE 1

| | Image toner reproduction | Light resistance | Fixability | Color balance at high concentration |
|---|---|---|---|---|
| Example | | | | |
| 1 | ○ | ○ | ○ | ○ |
| 2 | ○ | ○ | ○ | ○ |
| 3 | ○ | ○ | ○ | ○ |
| 4 | ○ | ○ | ○ | ○ |
| 5 | ○ | ○ | ○ | ○ |
| Comparative Example | | | | |
| 1 | ○ | x | ○ | ○ |
| 2 | ○ | ○ | ○ | x |
| 3 | x | ○ | ○ | x |
| Reference Example | | | | |
| 1 | x | ○ | ○ | ○ |
| 2 | ○ | ○ | x | ○ |
| 3 | x | ○ | ○ | ○ |

(Note)

Image tone reproduction:

○: The color image reproduced is excellent in fidelity throughout entire regions including the highlight portion and the shadow portion.

X: The color image reproduced is insufficient in fidelity throughout entire regions including the highlight portion and the shadow portion.

Light resistance: The surface of color image is subjected to light irradiation for 80 hours, and the fading ratio was measured by making use of a xenon fade meter.

○: The fading ratio was less than 5%.

X: The fading ratio was not less than 5%.

Fixability: The magnitude of tailing of image portion when the surface of color image was rubbed by the ordinary force using one's nail.

○: No tailing.

X: The periphery of the image portion was stained.

Color balance at high density: Differences in optical density among each color components, i.e. cyan, magenta and yellow when these colors were printed at the density of full solid (ink density when three colors were superimposed).

○: Less than 10%.

X: Not less than 10%.

As shown in the above Table 1, the thermal transfer recording medium according to this invention (Example 1) was effective in obtaining a color image which was excellent in tone reproduction, thereby enabling to faithfully reproduce an image with high density and excellent color balance throughout entire regions including the highlight portion and the shadow portion. Additionally, it was found possible to obtain a thermal transfer recording medium which was excellent in durability of image printed, thus achieving the object of this invention.

EXAMPLE 2

The same procedures as described in Example 1 were repeated except that the following black ink composition was included in the ink composition for thermal transfer recording layer in addition to the compositions of three colors, i.e. cyan, red and yellow, thereby producing a color image consisting of four primary colors.

(Black Ink)

| | |
|---|---|
| Carbon black | 9 parts |
| Epoxy resin (Yuka Shell Epoxy KK; Epicoat 1007) | 20 parts |

Softening point: 128° C.; epoxy equivalent: 1750–2200; weight-average molecular weight: 2900.

| | |
|---|---|
| Colorless fine particles (silica; Nihon Aerogel Co., Ltd. Aerogel R972) | 4 parts |
| Methylethyl ketone | 67 parts |

The image obtained in this example was found almost the same in features as that obtained in Example 1.

EXAMPLE 3

By making use of the same ink compositions as described in Example 2, a color image was produced using three colors, i.e. cyan, magenta and yellow, and at the same time, a binary image such as letters and bar codes was produced using the black ink. As a result, the images thus obtained were found excellent various properties as described in Example 1, and the letters as well as the bar codes were also excellent in fastness.

EXAMPLE 4

By making use of the thermal transfer recording medium obtained in Example 1, an image was reproduced on an image-receiving sheet having a formulation as described below.

(Construction of the Image-receiving Sheet)

Each of the ink formulations was successively coated on a polyester film having a thickness of 25 $\mu$m, and dried to obtain an image-receiving sheet bearing thereon a laminated structure consisting of a releasing layer and an image-receiving layer, which layers are repeatedly laminated.

(Ink for the Releasing Layer)

| | |
|---|---|
| Acrylic resin | 20 parts |
| Methylethyl ketone | 40 parts |
| Toluene | 40 parts |
| (Ink for image-receiving layer) | |
| Epoxy resin (Yuka Shell Epoxy KK; Epicoat 1007) | 30 parts |

Softening point: 128° C.; epoxy equivalent: 1750–2200; weight-average molecular weight: 2900.

| | |
|---|---|
| Methylethyl ketone | 70 parts |

After the image-receiving sheet bearing an image was superimposed on an end product sheet, a heat roller was applied from the reverse side of the image-receiving sheet to perform a thermal transferring of the image. Subsequently, when only the polyester film was peeled off, it was possible to obtain an excellent image-bearing article which was covered with a protective layer.

EXAMPLE 5

By making use of the thermal transfer recording medium obtained in Example 1, an image was reproduced on an image-receiving sheet having a formulation as described below.

(Construction of the Image-receiving Sheet)

An ink for releasing layer and an ink for hologram-forming layer were successively coated on a polyester film having a thickness of 25 $\mu$m, and dried to obtain a releasing layer and a hologram-forming layer. Then, a heat embossing press was employed to form a projected and recessed pattern constituting a hologram on the surface of the hologram-forming layer.

(Ink for the Releasing Layer)

| | |
|---|---|
| Acrylic resin | 20 parts |
| Methylethyl ketone | 40 parts |
| Toluene | 40 parts |

(Ink for the Hologram-forming Layer)

| | |
|---|---|
| Vinyl chloride-vinyl acetate copolymer | 20 parts |
| Urethane resin | 15 parts |
| Methylethyl ketone | 70 parts |
| Toluene | 30 parts |

After ZnS was deposited to form a transparent thin film on the surface of hologram-forming layer, an ink for image-forming layer having the following composition was coated and dried to form an image-receiving layer, thus obtaining an image-receiving sheet.

(Ink for Image-receiving Layer)

| | |
|---|---|
| Epoxy resin (Yuka Shell Epoxy KK; Epicoat 1007) | 20 parts |

Softening point: 128° C.; epoxy equivalent: 1750–2200; weight-average molecular weight: 2900.

| | |
|---|---|
| Urethane resin | 10 parts |
| Methylethyl ketone | 70 parts |

After the image-receiving sheet bearing an image was superimposed on an end product sheet having an-ultraviolet fluorescent agent-printed surface, a heat roller was applied from the reverse side of the image-receiving sheet to perform a thermal transferring of the image. Subsequently, when only the polyester film was peeled off, it was possible to obtain an excellent image-bearing article which was covered with a protective layer.

Since the image-bearing article thus obtained was accompanied with a hologram image functioning as a security, it was useful for enhancing security.

The results of Examples 2 to 5 are also shown in the above Table 1.

As explained above, according to the thermal transfer recording medium of the first embodiment of this invention, it is possible to obtain an image which is excellent in tone reproduction based on area gradation. In particular, it is possible according to the thermal transfer recording medium of the first embodiment to realize the sharp cutting of the transfer recording layer on the occasion of thermal transferring. Additionally, it is possible according to the thermal transfer recording medium of the first embodiment to obtain a transfer image which is high in optical density, and excellent in shelf life, and particularly in light resistance and mechanical strength.

EXAMPLE 6

An ink composition for thermal transfer recording layer having the following composition was prepared.

(Cyan Ink)

| | |
|---|---|
| Phthalocyanin Blue | 9 parts |
| Epoxy resin (Yuka Shell Epoxy KK; Epicoat 1007) | 20 parts |

Softening point: 128° C.; epoxy equivalent: 1750–2200; weight-average molecular weight: 2900.

| | |
|---|---|
| Colorless fine particles (silica; Nihon Aerogel Co., Ltd. Aerogel R972) | 4 parts |
| Methylethyl ketone | 67 parts |
| (Nagenta ink) | |
| Pigment Red 254 | 9 parts |
| Epoxy resin (Yuka Shell Epoxy KK; EpiCoat 1007) | 20 parts |

1750–2200; weight-average molecular weight: 2900.

| | |
|---|---|
| Colorless fine particles (silica; Nihon Aerogel Co., Ltd. Aerogel R972) | 4 parts |
| Methylethyl ketone | 67 parts |
| (Yellow ink) | |
| Disazo Yellow | 9 parts |
| Epoxy resin (Yuka Shell Epoxy KK; Epicoat 1007) | 20 parts |

Softening point: 128° C.; epoxy equivalent: 1750–2200; weight-average molecular weight: 2900.

| | |
|---|---|
| Colorless fine particles (silica; Nihon Aerogel Co., Ltd. Aerogel R972) | 4 parts |
| Methylethyl ketone | 67 parts |

The inks each having the aforementioned formulation for thermal transfer recording layer were coated successively on the surface of a polyethylene terephthalate film having a thickness of 5.4 μm, the reverse surface thereof being subjected to heat resistance treatment, thereby obtaining a cyan layer having a thickness of 0.5 μm (dry thickness), a Magenta layer having a thickness of 0.5 μm (dry thickness) and a yellow layer having a thickness of 0.8 μm (dry thickness). The coated layers were then dried to obtain a thermal transfer recording medium of this invention.

Then, the following ink for image-receiving layer was coated on the easy adhesion surface of an easy adhesive polyester film having a thickness of 100 μm to form a film having a thickness of 5 μm (dry thickness), which was dried, thereby obtaining an image-receiving sheet.

(Ink for Image-receiving Layer)

| | |
|---|---|
| Epoxy resin (Yuka Shell Epoxy KK; Epicoat 1007) | 30 parts |

Softening point: 128° C.; epoxy equivalent: 1750–2200; weight-average molecular weight: 2900.

| | |
|---|---|
| Methylethyl ketone | 70 parts |

The image-receiving sheet thus obtained was superimposed on the thermal transfer recording surface of the thermal transfer recording medium for cyan, and then, by making use of a thermal head, a cyan image based on the area gradation corresponding to the heating element of the thermal head was formed. Then, by making use of the thermal transfer recording medium for magenta, a magenta image based on the area gradation was formed on the image-receiving sheet bearing the cyan image in the same manner as employed for forming the cyan image. Likewise, a yellow image was formed on the image-receiving sheet, thereby forming a color image based only on the area gradation on the image-receiving sheet.

COMPARATIVE EXAMPLE 4

The inks for thermal transfer recording layer, each having the same formulation as that of Example 6, were coated successively on the surface of a polyethylene terephthalate film having a thickness of 5.4 μm, the reverse surface thereof being subjected to heat resistance treatment, thereby obtaining a cyan layer, a magenta layer and a yellow layer, each layer having a thickness of 0.8 μm (dry thickness). The coated layers were then dried to obtain a thermal transfer recording medium.

The same image-receiving sheet as that of Example 1 was superimposed on the thermal transfer recording surface of the thermal transfer recording medium for cyan, and then, by making use of a thermal head, a cyan image based on the area gradation corresponding to the heating element of the thermal head was formed.

Then, by making use of the thermal transfer recording medium for magenta, a magenta image based on the area gradation was formed on the image-receiving sheet bearing the cyan image in the same manner as employed for forming the cyan image. Likewise, a yellow image was formed on the image-receiving sheet, thereby forming a color image based only on the area gradation on the image-receiving sheet.

The reflection density of each color in all of the images obtained in Example 6 and Comparative Example 4 was found excellent, falling within the range of 1.3 to 1.5. Then, when the tone reproduction of image was evaluated for the purpose of comparison, the color image of Example 6 was found excellent in fidelity throughout entire regions including the highlight portion and the shadow portion. However, in the case of Comparative Example 4, the dots of both magenta and yellow were found unstable, thus making the images thereof prominent in discoloration as a whole.

As explained above, according to the thermal transfer recording medium of the second embodiment of this invention, it is possible to obtain an image which is excellent in tone reproduction based on area gradation, and in shelf life, and particularly in light resistance and mechanical strength.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A thermal transfer recording medium comprising;

a substrate; and multi-color thermal transfer recording layers, each of said multi-color thermal transfer recording layers being repeatedly formed for each color along the longitudinal direction of said substrate;

wherein each of said multi-color thermal transfer recording layers contains a coloring pigment, an amorphous organic polymer and fine-particles, and at least one of said multi-color thermal transfer recording layers is formed to have a larger thickness than the other of said multi-color thermal transfer recording layers.

2. The thermal transfer recording medium according to claim 1, wherein said multi-color thermal transfer recording layers are formed of at least three color thermal transfer recording layers bearing cyan, magenta and yellow, respectively, and yellow color thermal transfer recording layer is formed to have a larger thickness than the thickness of the cyan color thermal transfer recording layer and than the magenta color thermal transfer recording layer.

3. The thermal transfer recording medium according to claim 1, wherein the thickness of said thermal transfer recording layers is in the range of 0.2 to 1.0 $\mu$m.

4. The thermal transfer recording medium according to claim 3, wherein the thickness of the yellow color thermal transfer recording layer is in the range of 0.61 to 1.0 $\mu$m, the thickness of the cyan color thermal transfer recording layer and the thickness of the magenta color thermal transfer recording layer are both in the range of 0.2 to 0.6 $\mu$m.

5. The thermal transfer recording medium according to claim 1, wherein each of said thermal transfer recording layers contains 20 to 30 parts by weight of the coloring pigment, 40 to 80 parts by weight of the amorphous organic polymer, and 5 to 30 parts by weight of the fine particles.

6. The thermal transfer recording medium according to claim 1, wherein said amorphous organic polymer is epoxy resin having a softening point of 70 to 150° C.

7. The thermal transfer recording medium according to claim 1, wherein said fine particle is silica.

8. A method of forming an image by means of a thermal head and by making use of the thermal transfer recording medium claimed in claim 1, said method comprising a step of thermally transferring thermal transfer recording layers of said thermal transfer recording medium to an image-receiving member on a basis of image data to thereby form an image based on an area gradation;

said image-receiving member being provided, on the image reception surface thereof, with a layer containing the same kind of amorphous organic polymer as the amorphous organic polymer included in said thermal transfer recording layers.

9. An image-bearing article comprising;

an image carrier; and transferred multi-color image of dots formed on said image carrier through a successive thermal transferring using the thermal transfer recording medium claimed in claim 1;

wherein the dots of at least one color in the transferred multi-color image is formed to have a larger thickness than that of the dots of the other color in the transferred multi-color image.

10. The thermal transfer recording medium according to claim 9, wherein said multi-color thermal transfer recording layers are formed of at least three color thermal transfer recording layers bearing cyan, magenta and yellow, respectively, and not less than 80% by weight of said coloring pigment is formed of an organic pigment.

11. The thermal transfer recording medium according to claim 9, wherein an average particle diameter of said coloring pigment contained in said thermal transfer recording medium is 0.5 $\mu$m or less, and a ratio of coloring pigment having a particle diameter of more than 1 $\mu$m in a distribution of particle diameter is not more than 10%.

12. The thermal transfer recording medium according to claim 9, wherein said thermal transfer recording medium is free from crystalline wax.

13. A method of forming an image by means of a thermal head and by making use of a plurality of thermal transfer recording mediums of different colors, each of the thermal transfer recording mediums comprising a substrate and a single-color thermal transfer recording layer formed on said substrate and containing a coloring pigment, an amorphous organic polymer and fine particles, said method comprising a step of successively thermally transferring the single-color thermal transfer recording layers of said thermal transfer recording mediums for each color to an image-receiving member on a basis of image data to thereby form an image based on an area gradation, wherein the single-color thermal transfer recording layer of one thermal transfer recording medium is formed to have a larger thickness than the single-color thermal transfer recording layer of the other thermal transfer recording medium.

14. A thermal transfer recording medium comprising;

a substrate; and multi-color thermal transfer recording layers, each of said multi-color thermal transfer recording layers being repeatedly formed for each color along the longitudinal direction of said substrate;

wherein each of said multi-color thermal transfer recording layers contains a coloring pigment, an amorphous organic polymer and fine particles, and each of said multi-color thermal transfer recording layers which are successively transferred, excluding the color thermal transfer recording layer to be transferred latest, is formed to have an average thickness of 0.6 $\mu$m or less.

15. A method of forming an image by means of a thermal head printer and by making use of the thermal transfer recording medium claimed in claim 11, said method comprising a step of thermally transferring thermal transfer recording layers of said thermal transfer recording medium to an image-receiving member on a basis of image data to thereby form an image based on an area gradation;

said image-receiving member being provided, on the image reception surface thereof, with a layer containing the same kind of amorphous organic polymer as the amorphous organic polymer contained in said thermal transfer recording layers.

16. An image-bearing article comprising;

an image carrier; and a transferred multi-color image of dots formed on said image carrier through a successive thermal transferring using the thermal transfer recording medium claimed in claim 14;

wherein the dots of said transferred color image excluding the dots of transferred color image positioned highest in the superimposed dots of multi-color which are successively transferred, are formed to have an average thickness of 0.6 $\mu$m or less.

17. An image-bearing article comprising;

an image carrier; and a transferred multi-color image of dots formed on said image carrier from an intermediate image carrier having dots of an intermediate multi-color image transferred through a successive thermal transferring using the thermal transfer recording medium claimed in claim 14;

wherein the dots of said transferred color image excluding the dots of transferred color image positioned lowest in the superimposed dots of multi-color which are successively transferred, are formed to have an average thickness of 0.6 $\mu$m or less.

18. A method of forming an image by means of a thermal head and by making use of a plurality of thermal transfer recording mediums of different colors, each of the thermal transfer recording mediums comprising a substrate and a single-color thermal transfer recording layer formed on said substrate and containing a coloring pigment, an amorphous organic polymer and fine particles, said method comprising a step of successively thermally transferring the single-color thermal transfer recording layers of said thermal transfer recording mediums for each color to an image-receiving member on a basis of image data to thereby form an image based on an area gradation, wherein each of said single-color thermal transfer recording layers which are successively transferred, excluding the single-color thermal transfer recording layer to be transferred latest, is formed to have an average thickness of 0.6 $\mu$m or less.

* * * * *